United States Patent [19]

Newman

[11] 4,456,081

[45] Jun. 26, 1984

[54] HYDRAULIC DRILLING JAR

[76] Inventor: James L. Newman, 970 Stacewood, Beaumont, Tex. 77706

[21] Appl. No.: 404,471

[22] Filed: Aug. 2, 1982

[51] Int. Cl.[3] ..... E21B 31/113

[52] U.S. Cl. ..... 175/297; 277/195; 277/296; 277/203

[58] Field of Search ..... 175/296, 297; 166/278; 277/203, 195, 196

[56] References Cited

U.S. PATENT DOCUMENTS

| | | | |
|---|---|---|---|
| 1,279,948 | 9/1918 | Wackenhuth | 277/195 UX |
| 1,721,125 | 7/1929 | Kirk | 277/195 |
| 2,801,078 | 7/1957 | Medders et al. | 175/297 X |
| 2,802,703 | 8/1957 | Harrison | 255/27 |
| 2,987,129 | 6/1961 | Webb | 175/297 |
| 2,988,147 | 6/1961 | Webb | 175/297 X |
| 3,371,730 | 5/1968 | Newman | 175/300 |
| 3,585,301 | 6/1971 | Newman | 175/300 |
| 4,004,643 | 1/1977 | Newman | 175/321 |
| 4,200,158 | 4/1980 | Perkins | 166/178 X |
| 4,226,289 | 10/1980 | Webb et al. | 175/297 |

*Primary Examiner*—Ernest R. Purser

*Attorney, Agent, or Firm*—Hubbard, Thurman, Turner & Tucker

[57] ABSTRACT

A bidirectional hydraulic drilling jar includes an elongated mandrel telescopingly disposed within a body and defining spaced apart fluid chambers separated by a restricted bore portion of the body. The mandrel is provided with spaced apart positive mechanical seal assemblies engageable with the restricted bore portion to form a hydraulic dashpot to retard movement of the mandrel in each direction over a limited stroke length so that the spring tension or weight of the drill stem may become effective to deliver an impact blow when the seal assemblies move out of sealing engagement with the restriction. Back-to-back check valves are arranged to bridge the respective seal assemblies to reduce the length of stroke required to cock and trip the jar in each direction. A separate orifice or flow restricting passage is provided across the seal assemblies so that the retarding effect is independent of coacting seal surfaces between the mandrel and the jar body. Rotary driving torque and impacting in the upward direction are absorbed by a replaceable mandrel sleeve member. The positive mechanical seals include a spiral cylindrical seal ring which is backed on its inner diameter by a piston ring type seal member so that a radially expandable substantially zero gap seal is provided between the opposed fluid chambers when the seal assembly is effectively engaged with the bore restriction in the body.

33 Claims, 11 Drawing Figures

HYDRAULIC DRILLING JAR

BACKGROUND OF THE INVENTION

1. Field of the Invention

The present invention pertains to a hydraulic bidirectional drilling jar insertable in a drill stem for delivering impact blows in an upward or downward direction to the drill stem.

2. Background Art

In the art of drilling jars for delivering blows to a drill stem or to components lodged in a well bore, there have been several inventions directed to providing a tool which utilizes a hydraulic dashpot arrangement wherein, when the tool is interposed in the drill stem, a predetermined force may be imposed on the tool and, upon sudden release of a trapped quantity of hydraulic fluid within the tool mechanism, an impact blow is delivered to the drill stem.

One of the problems with prior art hydraulic type drilling jars pertains to the arrangement of relatively moving parts which provide, in effect, an orifice to restrict the flow of hydraulic fluid during the cocking action of the jar. Known types of hydraulically actuated drilling jars such as that disclosed in U.S. Pat. No. 2,802,703 rely on predetermined clearances between the relatively moving parts to control the flow of hydraulic fluid and the "dashpot" action. Unfortunately, the cooperating parts which provide the control orifices for the hydraulic dashpot are also working parts which are subject to manufacturing tolerances on the part dimensions and to wear in use whereupon the clearance between the parts varies so that the operating characteristics of the hydraulic dashpot are also subject to variation. A tool such as the type disclosed in the aforementioned patent is also subject to malfunction due to the reliance on movement of tool components under forces which cannot be easily controlled to enable resetting of the tool. The problems associated with prior art drilling jars cannot be tolerated particularly in jars that are employed in a working drill stem in deep hole drilling, for example, where the reliability and operating characteristics of a downhole tool must be given special consideration.

Another disadvantage with certain types of prior art hydraulic drilling jars pertains to the unidirectional characteristics of these jars, that is, they are capable of delivering an impact blow in only one direction and must be coupled with a second jar of either the mechanical or hydraulic type to provide bidirectional jarring capability. Such arrangements are expensive and suffer from the inherent disadvantage of adding still further complicated mechanism to the drill stem downhole. Yet another problem with prior art drilling jars pertains to: (1) the uncertainty of the relative positions of the parts of the jar during the resetting or recocking operation, (2) the distance over which the mechanism must be moved to reset the jar, and (3) the length of time required to reset the jar for another blow.

In order to overcome one of the problems inherent with prior art drilling jars which rely on orifices or restrictions provided by relatively moving parts, it was determined in pursuing the present invention, that it would be desirable to develop a substantially positive mechanical seal capable of withstanding the pressure and temperature conditions of a typical operating environment of drilling jars. Until the development of the present invention, satisfactory seal arrangements and hydraulic dashpot arrangements for downhole drilling jars have gone unfulfilled. The development of a tool which is adapted for either intermittent or continuous use in a drill stem, which is easily serviced and repaired, is adapted for rapid cocking and tripping, and is economical to manufacture has heretofore eluded workers in the drilling jar art. Moreover, those familiar with the art of downhole tools in the well drilling industry readily appreciate the desire and need for a drilling jar which is mechanically uncomplicated, is relatively compact, has bidirectonal capability and is capable of repeated use without malfunction or without uncontrolled variation in the blow intensity.

SUMMARY OF THE INVENTION

The present invention provides an improved hydraulic drilling jar which may be inserted in a working drill stem as part of the operating drill string, or may be used in conjunction with a fishing operation and which is capable of providing repeated impact blows in both upward and downward directions.

One aspect of the present invention pertains to an arrangement of positive mechanical sealing elements disposed on an elongated mandrel and which are cooperable with a restricted bore portion formed in the jar body whereby the transfer of hydraulic fluid from one chamber to another within the jar is forced through a controlled orifice and is not subject to reliance on clearance spaces formed by parts having dimensional tolerances and which are subject to wear with use. The improved mechanical seal arrangement of the drilling jar of the present invention is adapted to operate at relatively large differential pressures in the range of 40,000 to 50,000 psig while undergoing linear sliding movement of a seal element within the restricted bore in the jar body. The particular seal configuration is adapted to withstand high differential pressures, is able to accommodate variations in the dimensions of the sealing surfaces and, advantageously utilizes differential pressures to force the sealing elements into greater sealing contact with the cooperating seal surfaces on the seal elements and the cooperating parts.

In accordance with another aspect of the present invention, there is provided a drilling jar which includes a hydraulic dashpot having a predetermined restriction or orifice for controlling the flow of fluid from one chamber to another, which orifice may be selectively varied in size in accordance with predetermined operating requirements of the drill stem.

In accordance with another aspect of the present invention, there is provided a hydraulic drilling jar which is mechanically uncomplicated with regard to the mechanism for providing the hydraulic dashpot action and which is also adapted for providing the hydraulic dashpot in opposite directions of movement of an elongated mandrel with respect to the body of the drilling jar so that impact blows may be delivered in both an upward and downward direction.

The drilling jar of the present invention is also adapted to provide cooperating parts which permit rotary drilling torque to be transmitted through the jar substantially continuously so that the jar may be utilized as a more or less permanent part of the drill stem. The jar is provided with a mandrel and a body which are axially movable relative to each other and are in rotary driving engagement through a set of splines provided in the bore of the body and on a replaceable sleeve secured to the mandrel. One end of the mandrel sleeve also serves as an anvil surface for delivering impact blows to the upper end of a portion of the jar body. Accordingly, a component which is subject to wear from rotary driving as well as axial impact forces is provided as a separate part which may be easily replaced without requiring replacement of an entire mandrel and wash pipe assembly.

The particular arrangement of the mandrel and mandrel sleeve within the body of the drilling jar of the present invention also simplifies the structure in regard to sealing a hydraulic dashpot chamber which is used to receive and discharge fluid when the jar is being operated to deliver an impact blow to the drill stem.

Another feature of the present invention which improves the operability of a bidirectional drilling jar, is an arrangement of passages which include back-to-back or opposed check valves which permit rapid movement of the jar in opposite directons to transfer fluid between the dashpot chambers to reduce the resetting time for delivering successive impact blows.

The development of the present invention has been directed to the provision of several advantages and superior features which are due to specific elements within the structure as well as the combination of all of the elements of the jar working in a somewhat synergistic fashion. First of all, the jar is bidirectional and the blow intensity may be easily adjusted by the drill stem operator by adjusting the rate of pulling or slacking off on the drill stem or by varying the distance over which the mandrel is moved during a resetting operation. The adjustment of blow intensity can thereby be accomplished without pulling the jar from the drillhole and making external adjustments. Moreover, the adjustments to the jar blow delivering capability may also be provided without requiring rotation of the drill stem.

The drilling jar of the present invention is relatively mechanically uncomplicated as compared with prior art hydraulic drilling jars, particularly of the type which are capable of bidirectional operation. Moreover, the overall length of the drilling jar is substantially less than prior art bidirectional jar arrangements.

The drilling jar of the present invention is also provided with relatively few working parts which are subject to wear, and those parts which are considered wear or expendable parts are mechanically uncomplicated and relatively easy to replace without requiring the replacement of major portions of the complete tool.

The hydraulic dashpot action of the drilling jar is determined by a member which includes a precision orifice, which member may be easily replaced so that orifices of different sizes may be inserted in the jar in accordance with the anticipated operating conditions in the well. For example, if a hydraulic fluid of variable viscosity is being used and the average operating temperature of the jar is known, an orifice may be selected in accordance with the fluid flow rates associated with the performance requirements expected. Since the hydraulic dashpot action relies on the use of an orifice of predetermined size which is not subject to mechanical interaction with other parts, there is no change in the operating characteristics of the tool as a result of wear. A plurality of orifice members may be provided so that if an orifice should becomed plugged due to contamination of the hydraulic system, the tool will continue to be functional subject only to a change in its overall operating characteristics.

The drilling jar of the present invention utilizes a unique positive mechanical seal mechanism which is self-adjusting to compensate for differences in the controlled dimensions of mandrel diameter and the bore in the jar body. Moreover, the seal mechanism is not as sensitive to variations in manufacturing tolerances, wear, operating temperature and pressures.

The arrangement of the bidirectional drilling jar of the present invention also provides for operation of the tool in either the open or extended condition, or in the closed or collapsed condition, and the jar can be used as a suspension tool to control the weight on the drill bit under certain drilling conditions.

Those skilled in the art of drilling jars will appreciate the foregoing advantages and superior features of the instant invention as well as other salient aspects thereof upon reading the detailed description which follows in conjunction with the drawings.

DESCRIPTION OF THE PREFERRED EMBODIMENT

Figure 3A:
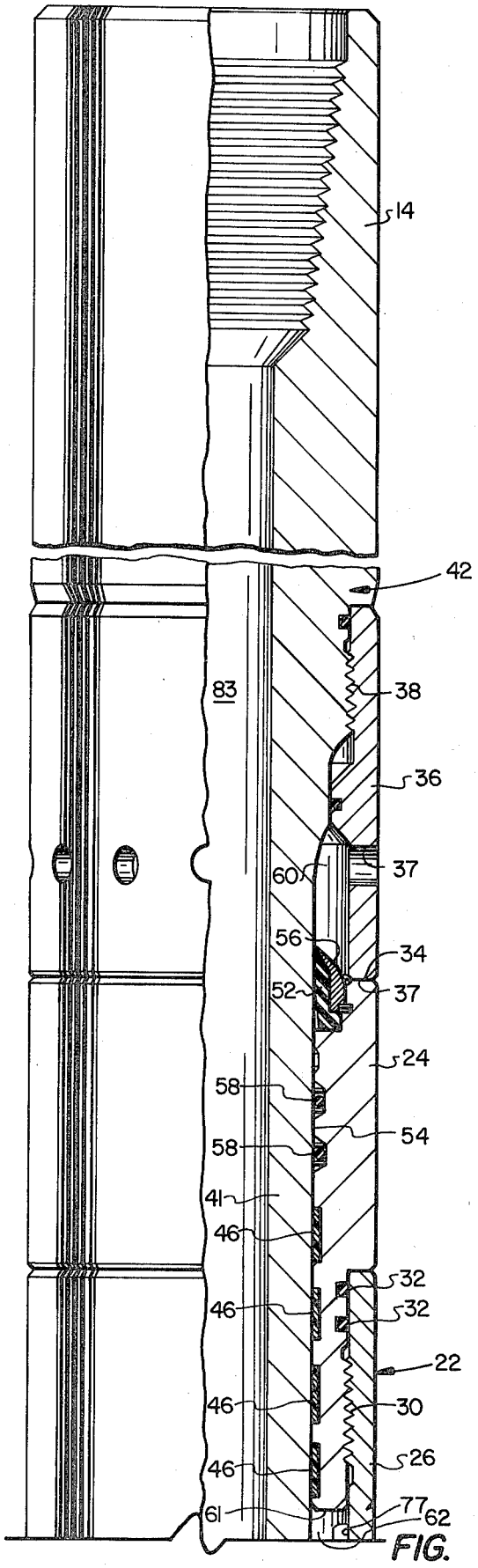
FIG. 3A is a longitudinal half section view of the portion of the drilling jar illustrated in FIG. 2 and substantially within the bracket 3A.

In the description which follows, like parts are marked throughout the specification and drawings with the same numerals, respectively. The drawing FIGS. 3B through 3D are intended to be viewed end to end as indicated by the arrangement of the brackets 3B through 3D in FIG. 2. In the description which follows, the terms "upward" and "downward" are used for convenience in describing the relative positions of the components of the apparatus when viewing the drawings and in the normal attitude of the apparatus in most applications. However, those skilled in the art will appreciate that the apparatus may be inverted or used in a generally horizontal or other directional attitude.

Figure 1:
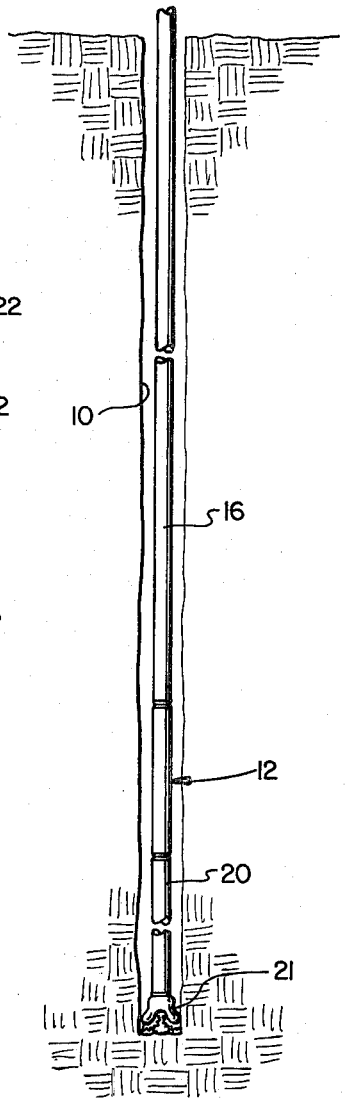
FIG. 1 is a longitudinal elevation showing the drilling jar of the present invention interposed in a portion of drill stem used in drilling relatively deep wells such as are required for recovering hydrocarbons.

Referring to FIG. 1, briefly, the apparatus of the present invention comprises a device known in the art as a drilling jar which is adapted to deliver impact blows in an upward or downward direction to dislodge a drill stem which may be stuck in a well bore or to dislodge a component which is to be retrieved from a well bore or the like. FIG. 1 illustrates the drilling jar of the present invention disposed in a generally vertical well bore 10, and generally designated by the numeral 12. The drilling jar 12 is provided with an upper end portion having a threaded box provided with internal threads for connection to the lower end of a drill stem 16. The drill stem 16 normally extends upward to connection with a component for rotating the stem such as a kelly or the like, not shown, engaged with suitable rotary driving apparatus mounted on a drilling rig, also not shown. The drill stem 16 would also be adapted for vertical movement under the control of hoisting apparatus such as a drawworks or the like comprising part of the drilling rig. The lower end of the jar 12 includes a threaded pin portion adapted to be connected to suitable drill collars 20 when the jar is interposed in a conventional drill string, as shown. It will be understood that the jar 12 may be used in various arrangements and the arrangement illustrated in FIG. 1 is exemplary of a particular location and specific application of the jar. As with most drilling operations, a cutting evacuation fluid is pumped down through a central bore in the drill stem and in the jar 12, through orifices in a drill bit 21 and up through the annulus formed between the drill stem and the well bore.

Figure 2:
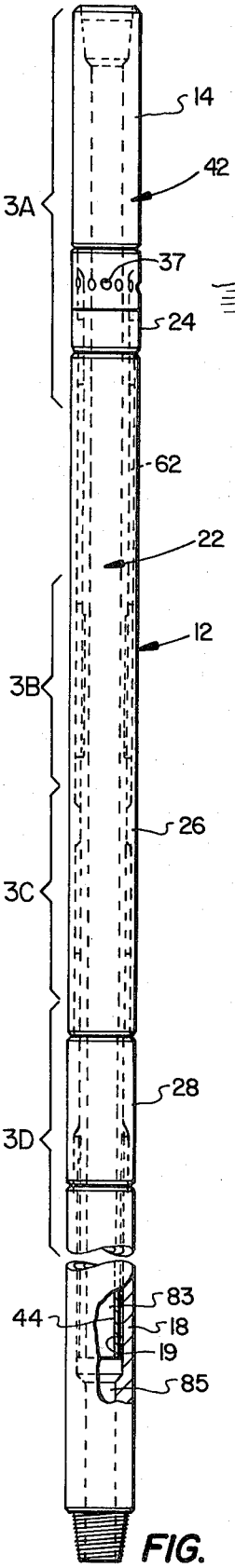
FIG. 2 is a longitudinal elevation view on a larger scale of the drilling jar illustrated in FIG. 1.
Figure 3B:
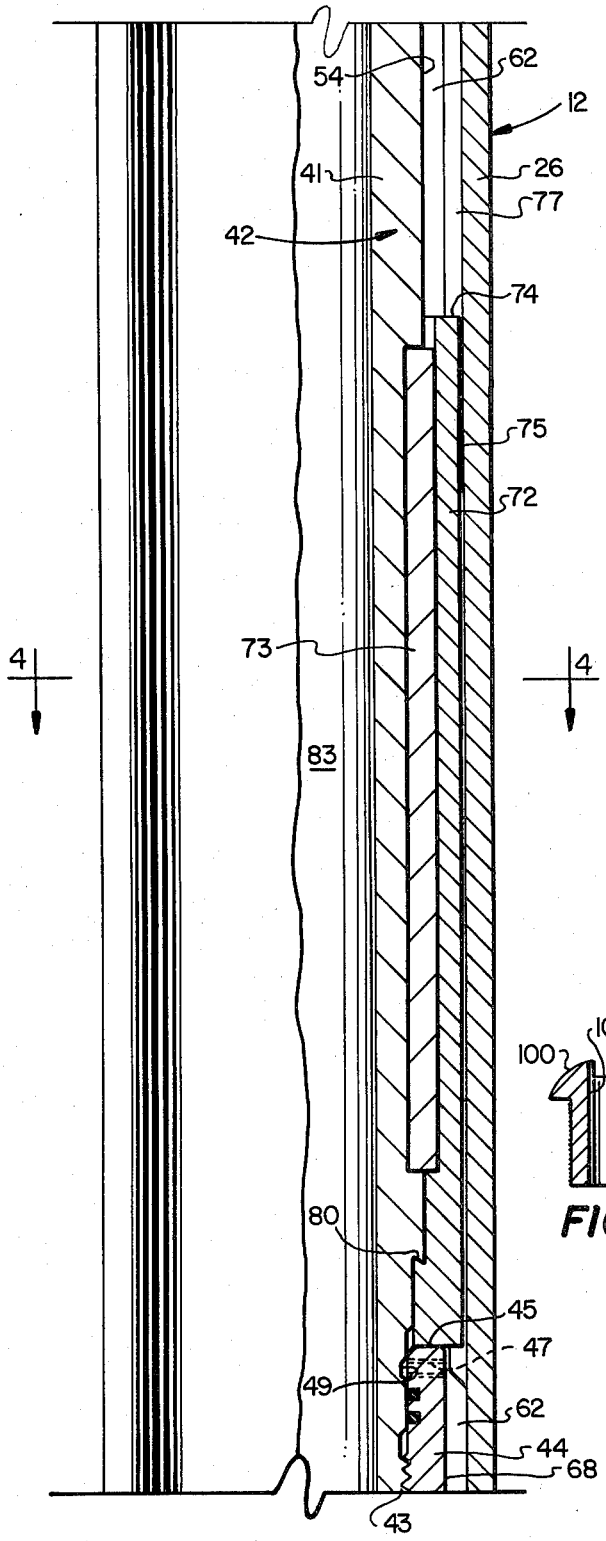
FIG. 3B is a longitudinal half section view of the portion of the drilling jar substantially within the bracket 3B in FIG. 2.
Figure 3C:
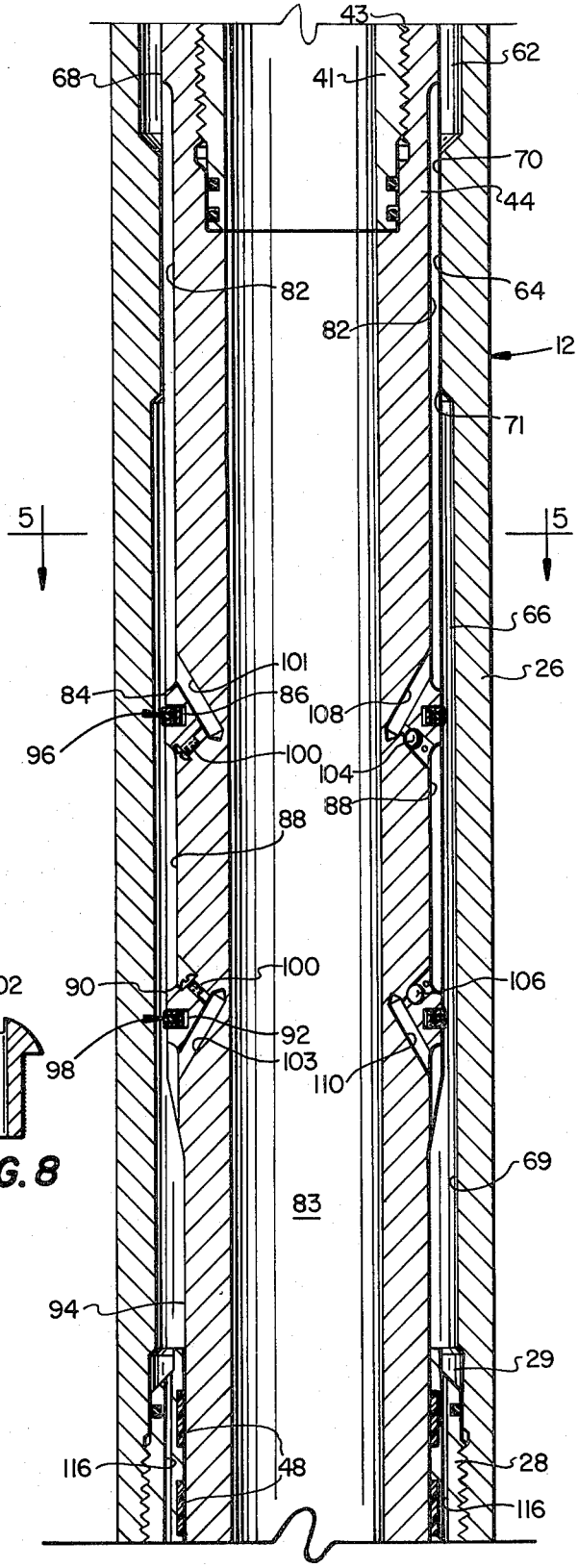
FIG. 3C is a longitudinal full section view of the portion of the drilling jar sustantially within the bracket C of FIG. 2.
Figure 3D:
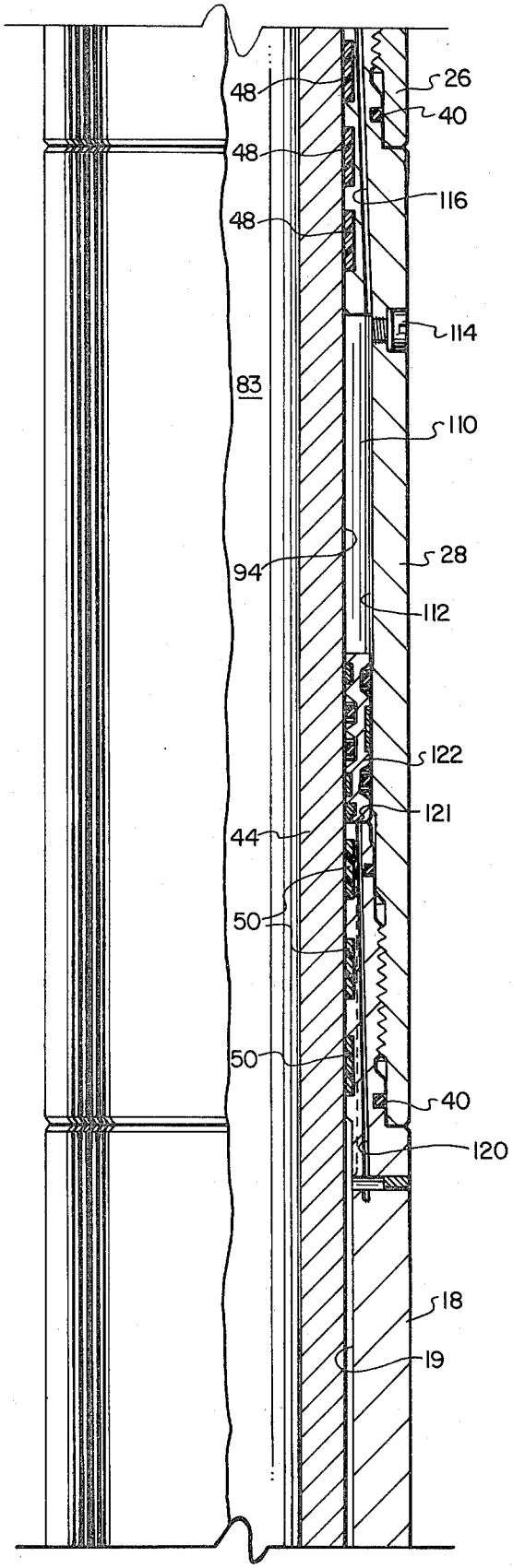
FIG. 3D is a longitudinal half section view of the portion of the drilling jar substantially within the bracket 3D of FIG. 2.

Referring now to FIG. 2, the drilling jar 12 is illustrated in the totally collapsed or telescoped condition and is characterized by an elongated cylindrical body member, generally designated by the numeral 22, which is made up of an upper sub part 24, a main body member 26, a floater body 28 and a lower sub 18. The upper sub 24 is connected to the main body 26 through a conventional cooperating threaded portion 30, FIG. 3A, with appropriate sealing members 32 interposed between the upper end of the main body member 26 and a reduced diameter portion of the upper sub. The upper sub 24 also includes an upwardly facing annular impact surface 34 which is adapted to be impacted by a removable cylindrical anvil member or knocker 36 having a downwardly facing anvil surface 37. The knocker 36 is suitably removably connected to the upper end portion 14 of an elongated mandrel, generally designated by the numeral 42, by cooperating threads 38. Referring to FIG. 3D, the lower end of the main body member 26 is threadedly connected to an upper end of the floater body 28 and the floater body is threadedly connected at its lower end to the upper end of the lower sub 18. The lower sub 18 and the floater body 28 are both provided with suitable annular seals 40 to prevent leakage of fluid in the well bore into the interior of the jar body at the respective threaded connections.

In the preferred embodiment of the jar 12, the upper sub 14 is integrally formed with the elongated cylindrical mandrel member 42 which is disposed in telescoping sleeved relationship within the body 22. Referring to FIGS. 3A through 3C, the mandrel 42 includes an elongated first part 41 having a threaded portion 43 at its lower end which is adapted to be engaged with a member 44 comprising a continuation of the mandrel and commonly referred to as a wash pipe. The wash pipe 44 extends downwardly through the body member 26, the floater body 28 and into an interior bore 19 of the sub 18. The mandrel 42, including part 41 and the wash pipe 44, is operable to move axially relative to the body 22 and is journaled for relative axial sliding movement by spaced apart sleeve bearings 46 disposed in the sub 24, bearings 48 disposed in the floater body 28, and additional bearings 50 disposed in the upper end of the lower sub 18. The bearings 46, 48 and 50 may be formed of suitable bearing material such as a carbon filled plastic or the like.

Referring to FIG. 3A, an annular wiper seal ring 52 is disposed in a suitable recess in the sub 24 and engageable with a cylindrical surface or seal diameter 54 of the mandrel part 41. The wiper 52 is provided with a bronze backing member 56. Additional o-ring or quad ring type seals 58 may be provided in the sub 24 and sealingly engaged with the surface 54. The knocker 36 is provided with a plurality of radial passages 37 to permit drilling fluid to flow freely in and out of the annular chamber 60 formed between the knocker member and the mandrel 42.

The downward facing annular end face 61 of the sub 24 faces an elongated interior chamber formed between the cylindrical surface 54 and the body member 26, which chamber is designated by the numeral 62. Referring to FIG. 3C, the chamber 62 is also delimited by a reduced diameter or restricted bore portion 64 of the body member 26. A second annular chamber 66 is formed between the wash pipe 44, the upper end of the floater body 28, and a cylindrical interior wall 69 of the body member 26. The restricted bore portion 64 on the body member 26 is delimited by upper and lower control edges 70 and 71, the function of which will be described in further detail herein.

The mandrel 42 is provided with an improved removable sleeve member generally designated by the numeral 72 in FIG. 3B. The mandrel sleeve 72 includes an upper transverse anvil surface 74 which is coactable with the anvil surface 61 on the sub 24 to deliver an impact blow to the body 22 and the drill stem connected thereto in response to rapid movement of the mandrel upwardly with respect to the body. The mandrel sleeve 72 is removable from the mandrel part 41 and is nonrotatably secured thereto by two opposed elongated keys 73 interfitted in suitable slots formed in the sleeve and the mandrel part 41, as shown also in FIG. 4. The mandrel sleeve 72 is retained on the mandrel part 41 by the wash pipe 44, as shown. In the secured and locked position of the wash pipe 44 on the mandrel 42, a small end clearance on the order of 0.020–0.030 inches is permitted between the lower end of the mandrel sleeve and the upper end face 45 of the wash pipe. The wash pipe 44 is also provided with one or more radially disposed locking screws 47 which are seated in a cooperating annular groove 49 in the lower end of the mandrel part 41 to prevent unwanted disengagement of the wash pipe from the remaining part of the mandrel. The mandrel sleeve 72 is prevented from axial displacement upward with respect to the mandrel part 41 by cooperating undercut shoulder portions designated by the numeral 80 in FIG. 3B.

Figure 4:
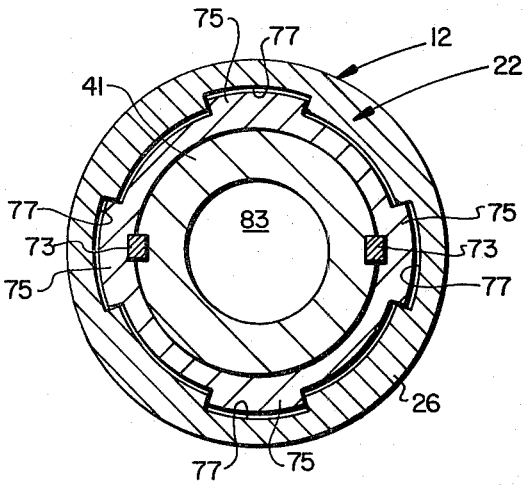
FIG. 4 is a transverse section view taken from the line 4—4 of FIG. 3B.

As shown in FIG. 4, the mandrel sleeve 72 is provided with a plurality of circumferentially spaced axially extending splines 75 which are interfitted in cooperating grooves 77 in the body member 26 so that rotary driving torque may be transmitted from the mandrel to the body or vice versa. However, the interfitting splines between the mandrel sleeve 72 and the body part 26 permit relative axial movement of the mandrel 42 with respect to the body 22. The mandrel sleeve 72 transmits all of the rotary driving torque between the mandrel 42 and the body 22, provides an anvil surface for delivering impact blows to the body 22 when jarring in the up direction, and may be easily replaced, if damaged or worn, without requiring replacement of the entire mandrel part 41. Moreover, the sleeve 72 is easily removed from the mandrel part 41 by releasing the screws 47 and unthreading the wash pipe 44 from the lower end of the mandrel part whereby the sleeve 72 may be axially removed from the lower end of the mandrel.

Figure 5:
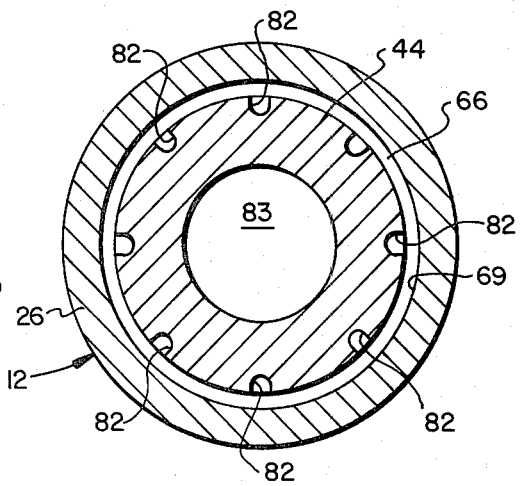
FIG. 5 is a transverse section view taken from the line 5—5 of FIG. 3C.

Referring now to FIG. 3C, and briefly to FIG. 5, the upper portion of the wash pipe 44 is provided with a plurality of circumferentially spaced, axially extending grooves 82 formed in the outer cylindrical surface 68 of the wash pipe and which extend axially downward to a cylindrical portion 84 having a circumferential seal ring groove 86 formed therein. A second set of axial grooves 88 corresponding substantially to the grooves 82 extend between the cylindrical portion 84 and a second axially spaced cylindrical portion 90 having a circumferential seal ring groove 92 formed therein. Downward from the seal ring groove 92, the outer diameter of the wash pipe is defined by a cylindrical surface 94 which is of a diameter less than the cylindrical surface portion 68.

Figure 8:
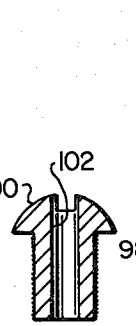
FIG. 8 is a section view of a threaded plug including the fluid flow control orifice.

Referring still further to FIG. 3C, respective positive mechanical seal assemblies 96 and 98 are disposed in the grooves 86 and 92. The seal assemblies 96 and 98 will be described in further detail herein. The seal assemblies 96 and 98 are adapted to be in sealing engagement with the wall of the restricted bore 64 to substantially seal the chamber 66 from the chamber 62 whereby fluid transferring from one chamber to the other, must pass through a control orifice formed in one of two plugs 100, depending on the position of the wash pipe with respect to the restricted bore 64. Referring briefly to FIG. 8, the plug 100 is characterized as a round head screw having an orifice 102 extending therethrough and formed of a predetermined diameter. The plugs 100 are interposed in respective passages 101 and 103 which interconnect the grooves 82 with one of the grooves 88, and the one groove with the portion of the chamber 66 below the cylindrical part 90 of the wash pipe, respectively, as shown. Relatively unrestricted flow of fluid between the chambers 62 and 66 is also provided around the respective seal assemblies 96 and 98 by back-to-back check valves 104 and 106 interposed in suitable passages 108 and 110, respectively. The passages 108 and 110 are arranged to interconnect one or more of the grooves 82 with another one of the grooves 88 and with the portion of the chamber 66 below the enlarged diameter portion 90 of the wash pipe as shown in FIG. 3C. The check valves 104 and 106 provide for fluid flow to effectively bypass the respective seal assemblies 96 and 98 when the seals are passing through the restricted bore 64 depending on the direction of movement of the mandrel 42 with respect to the body 22. The outer diameter of the wash pipe 44 between the cylindrical diameter portions 84 and 90 is sufficiently less than the restricted bore 64 to permit relatively unrestricted flow of fluid between respective ones of the grooves 88. The grooves 88 could be replaced by an annular recess but the lands formed between the grooves are provided to assist in guiding the wash pipe in the bore 64.

The chambers 62 and 66 are adapted to be filled with hydraulic fluid, preferably a fluid having a reduced viscosity variation with temperature, but having suitable lubricity to minimize wear on the cooperating sliding surfaces of the mandrel and the bearings as well as the splines 75, and the seal assemblies 96 and 98 with respect to the restricted bore 64. Even though the cooperating parts of the jar 12 are designed for minimal wear, the upper end of the floater body 28 is adapted to provide a reservoir portion 29 which, in the normal attitude of the jar 12, will collect loose wear material which settles out of the chambers 62 and 66.

Referring to FIG. 3D, hydraulic fluid may be introduced into the entire interior cavity formed between the mandrel and body portions of the jar, including the chambers 62 and 66, through a reservoir chamber 110 formed between the lower end of the wash pipe 44 and the inner bore wall 112 of the floater body 28. A removable reservoir fill plug 114 is suitably disposed in a cooperating threaded passage in the floater body 28, as illustrated, for filling the aforementioned chambers. The floater body 28 is provided with elongated passages 116 which interconnect the chamber 110 and the chamber 66. The minimum working pressure of the fluid within the chambers 110, 62 and 66 is preferably maintained at a level corresponding to the pressure of the drill cuttings evacuation fluid which is delivered to the bit through an elongated central passage 83 formed by suitable bores in the mandrel part 41, the wash pipe 44 and a passage 85 in the bottom sub 18, FIG. 2. Referring further to FIG. 2 and FIG. 3D, fluid in the passage 83 flows into the annular space between the circumferential surface 94 of the wash pipe and the bore wall 19 of the sub 18 into a passage 120 to a chamber formed between the upper end face 121 of the sub 18 and an annular floater piston 122. The piston 122 also defines the lower end of the chamber 110. Pressure exerted on the piston 122 by fluid introduced through the passages 120 will cause the pressure in the chambers 62, 66 and 110 to be nominally equal to the pressure in the passage 83, which pressure normally exceeds the fluid pressure in the wall annulus. Accordingly, any leakage of fluid with respect to the chambers 62, 66 and 110 will tend to flow out into the well annulus to reduce any tendency to contaminate the interior fluid chambers of the jar 12. Pressurizing the chambers 62, 66 and 110 to a minimum nominal pressure corresponding to the drilling fluid pressure eliminates any pressure differential across the seals between the passage 83 and these chambers which would tend to cause leakage of the drill cuttings evacuation fluid into the chambers from the passage 83. Moreover, the provision of the floater piston 122 and the reservoir 110 reduces or substantially eliminates any adverse effects resulting from fluid compressibility entrained gases in the hydraulic fluid and thermal expansion of the fluid.

The jar 12 may be operated in either the totally telescoped or collapsed condition as illustrated in the drawing figures, in a partially extended condition of the mandrel 42 with respect to the body 22, and in a totally extended condition of the mandrel with respect to the body wherein the cooperating anvil surfaces 61 and 74 are in engagement. An operation to provide an upward jarring action on the body 22 and the drill stem portion connected to the sub 18 will now be described assuming the jar is initially in the operating condition illustrated in the drawing figures or at least in a condition wherein the seal assembly 98 is below the control edge 71, viewing FIG. 3C. If an upward jar is required, the rig operator hoists the drill stem to begin pulling up on the mandrel 42. As the mandrel and wash pipe assembly move upward relative to the body 22, and the seal assembly 96 passes the control edge 71 thereby moving into sealing engagement with the wall of the restricted bore 64, the movement of the mandrel is not retarded thanks to the provision of the passage 108 and the check valve 104 which permits free flow of fluid from the chamber 62 into the chamber 66. Fluid is displaced from the chamber 62 during upward movement of the mandrel 42 due to the fact that the diameter of the portion of the wash pipe 44 delimited by the cylindrical surface 68 is greater than the diameter of the cylindrical surface 54 which is in sealing engagement with the upper sub 24. Accordingly, as the wash pipe 44 moves further into the chamber 62, the volume of this chamber is decreased and fluid must be displaced into the chamber 66, which is permitted because the volume of chamber 66 is increasing due to the difference between the diameters of the cylindrical surfaces 68 and 94. As the seal assembly 96 passes upwardly through the restricted bore 64, fluid is permitted to flow freely into the chamber 66 until the seal assembly 98 passes the control edge 71 and moves into sealing engagement with the wall of bore 64. At this point, as the mandrel 42 is pulled upward by the drill stem, fluid displaced from the chamber 62 must flow through the orifice 102 in the lower plug 100. The retarding effect of the orifice will result in an increased tension in the drill stem above the jar 12 and the stem will be elastically elongated to become, in effect, a tension spring. As the mandrel 42 moves upward with respect to the body 22 at the controlled retarded rate, the tension in the drill stem is maintained until the seal assembly 98 moves upwardly past the upper control edge 70. At this point, fluid in the chamber 62 may flow freely into the chamber 66 to release the mandrel for sudden relatively free upward movement. Since the drill stem, being of substantial length and having undergone substantial elongation, is now permitted to relax somewhat, the mandrel is moved upward rapidly until the anvil surface 74 engages the surface 61 with a substantial impact or jarring below.

In normal drilling operations, the jar 12 would be extended, that is, the mandrel 42 would be extended from the upper end of the body 22 to its limit position with the surfaces 61 and 73 engaged. Accordingly, when the rig operator sensed the need for applying an upward jarring movement to, for example, loosen a stuck portion of the drill stem below the sub 18, the operator would slack off hoist tension on the drill stem until the hoist load weight indicator displayed a marked decrease in tension on the drill stem. The weight loss would indicate that the mandrel 42 had moved axially downward with respect to the body 22 until the seal assembly 96 passed the control edge 70 into the restricted bore 64. The operator could then mark the position of a portion of the drill stem or kelly at the rig floor with respect to a reference point (such as the kelly bushing). In the position wherein the seal assembly 96 has passed downward past the control edge 70 the seal assembly 98 is in the restricted bore 64 or has passed below the control edge 71, depending on the axial spacing of the grooves 86 and 92 and the spacing of the control edges 70 and 71. The operator could then apply a predetermined upward pull on the drill stem in excess of the drill stem weight to impose an axial load on the mandrel, for example, 50,000 lbs., and set the brake on the drawworks. The action of the jar would then be a retarded upward movement of the mandrel 42 until the seal assembly 98 cleared the control edge 70 and the mandrel would be free to permit rapid elastic contraction of the drill stem to draw the mandrel rapidly upwardly until the anvil surfaces 74 and 61 impacted each other. The operator, upon sensing the tripping of the jar, could then repeat the cycle of cocking or resetting the jar by slacking off less weight on the drill stem with each repeated cycle in order to not let the seal assembly 98 move quite as deep into the restricted bore 64 between the control edges 70 and 71, thereby taking less time to pull the jar through the tensioning and tripping portion of the cycle. By viewing the position of the mark placed on the drill stem after each jarring action is completed, the operator may recognize any upward movement or loosening of the stuck portion of the stem. The aforedescribed procedure is exemplary but is indicative of a preferred method of using the inventive jar 12.

In order to perform a jarring action in the downward direction, and assuming that the jar in in the extended condition initially, the mandrel 42 is lowered into the body 22. As the seal assembly 98 passes the control edge 70 and into the restricted bore 64 pressure fluid is allowed to flow freely around the seal assembly through the passage 103 and check valve 106, from chamber 66 to chamber 62, until the seal assembly 96 passes the control edge 70 and into the restricted bore 64. At this point, movement of fluid from the chamber 66 to the chamber 62 may take place substantially only by flow through the orifice 102 in the plug 100 adjacent to the seal assembly 96. As the seal assembly 96 enters the restricted bore 64, the drill stem above the jar 12 may undergo some compressive deflection under its own weight as may that portion of the drill stem below the jar. Moreover, the weight of the drill stem itself may be sufficient to deliver a substantial blow by engagement of the cooperating anvil surfaces on the sub 24 and the knocker 36. This action will take place as the seal assembly 96 moves downward past the control edge 71 whereby fluid may rapidly flow out of the chamber 66 into the chamber 62 to permit rapid collapsing of the mandrel into the body and the deliverance of an impact blow to the anvil surface 34. Repeated downwardly directed impact blows may be obtained by pulling upward on the mandrel 42 until the seal assembly 96 moves past the control edge 71 and at least somewhat into the restricted bore 64, followed by slacking off of the hoisting effect on the mandrel sufficiently to permit the weight of the drill stem to force the mandrel back toward the collapsed condition. The operator may be assured that the seal assembly 96 has moved upward past the control edge 71 by observing an increased reading on the hoist load or weight indicator caused by movement of the seal assembly 98 into the restricted bore 64.

Thanks to the provision of the separate upper and lower orifice plugs 100 the orifice size may be selectively varied in one or both plugs to vary the maximum jarring action in one or both directions and to compensate for various types of fluid as well as operating temperature effects on fluid viscosity. Although only one orifice plug is shown for controlling the flow around the respective seal assemblies, multiple passages and orifices could be provided to bypass each seal 96 and 98.

Those skilled in the art will recognize from the foregoing description that an improved hydraulic bidirectional drilling jar is provided by the apparatus 12. Moreover, the jar 12 may also be used as a suspension tool to control weight on the drill bit. For example, during drilling operations, the rig operator may observe the hoist weight indicator to sense an increase in the suspended weight of the drill stem and then lowering the drill stem a predetermined length, but not enough to place the seal assemblies 96 or 98 downward past the control edge 70, followed by setting the drawworks brake until the weight indicator again indicates an increase in the suspended weight of the stem. This procedure can be repeated and as long as the mandrel is not fully extended from the body 22, the weight on the bit will remain substantially constant. Accordingly, the jar 12 may be utilized to control weight on the drill stem and bit below the point in the stem where the jar is located.

The development of the improved hydraulic drilling jar 12 includes the provision of the improved seal assemblies 96 and 98. The operating pressures experienced in the cavities 62 and 66 may result in a pressure differential across the seal assemblies 96 and/or 98 of as much as 40,000 to 50,000 psi. These operating pressures cannot be withstood by conventional seal elements such as o-rings, quad rings, chevron packings and other conventional elastomeric sealing elements. Furthermore, in many instances the operating temperatures experienced by downhole tools, and particularly a tool such as the jar 12, cannot be withstood by the aforementioned types of seals. Although a conventional split cylindrical piston ring type seal may be capable of withstanding the aforementioned pressure differentials and the temperature conditions, this type of seal provides a leakage path at the gap where the ring itself is split. This gap becomes another factor in the overall liquid flow area which controls the dashpot action of the drilling jar. Moreover, conventional piston ring type seals have a tendency to fail when required to move from a radially free position to a constrained position and vice versa such as is experienced by a seal entering and leaving the restricted bore 64.

Figure 6:
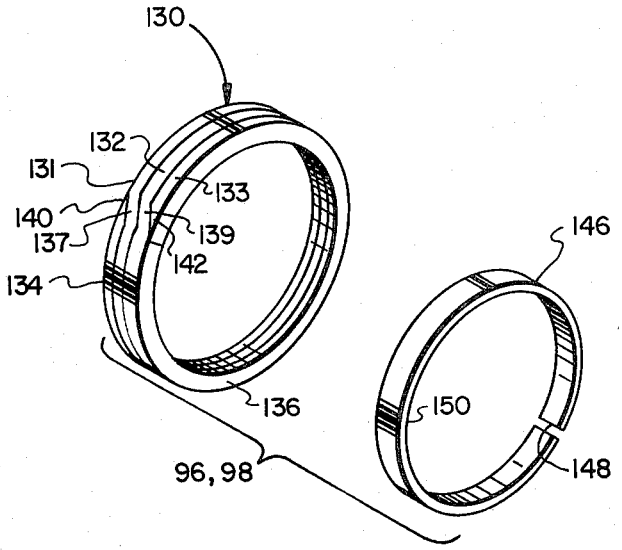
FIG. 6 is a detail section view on a larger scale showing the features of the mechanical seal arrangement for the wash pipe portion of the mandrel.
Figure 7:
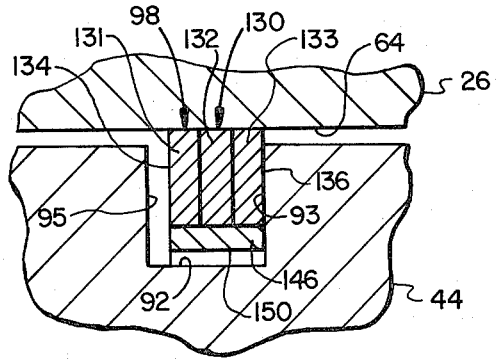
FIG. 7 is a perspective view of the seal elements for the seal assembly shown in FIG. 6.

In accordance with the present invention, an improved seal assembly is provided by a somewhat spiral type seal ring which is disposed around the periphery of an axial split cylindrical piston ring seal member. Referring now to FIGS. 6 and 7, the elements making up the seal assemblies 96 and 98 are illustrated in detail, particularly in FIG. 6. Each of the seal assemblies 96 and 98 includes a spiral seal ring generally designated by the numeral 130. The seal ring 130 comprises a spring tempered metal band of rectangular cross-section and forming aa plurality of convolutions 131, 132 and 133. The convolutions 131, 132 and 133 are configured so as to provide a ring having flat and parallel opposed sides 134 and 136. The transition between the convolution 131 and 132 is provided by a relatively short axially aligned portion 137 and the transition between the convolution 132 and 133 is provided by a second angled portion 139. The distal end of the convolution 131 is tapered at 140 and the opposing distal end of the convolution 133 is tapered at 142 so that the ring 130 assumes the shape of a substantially cylindrical annular member with flat parallel sides or end faces 134 and 136. The tapered ends 140 and 142 are feathered to essentially a sharp edge to provide a smooth surface of the faces 134 and 136, respectively, thereby minimizing any possible leakage space formed along the respective radially extending end edges of the ring. The convolutions 131, 132 and 133 are adapted to lie contiguous with each other to minimize or eliminate any leakage flow path between the axial facing surfaces of the convolutions. Alternatively, the convolutions of the ring 130 could follow a continuous helix and the parallel surfaces 134 and 136 could be formed by grinding the outer end faces of the convolutions 131 and 133.

The seal assemblies 96 and 98 also include, respectively, an annular piston ring type seal member 146 provided with an axial gap 148. The ring 146 is proportioned to be capable of elastic radial contraction to fit within the inside diameter or bore of the spiral seal ring 130 and thereby urge the ring 130 to expand radially to the extent that the outside circumferential surface of the ring 130 will be in fluid sealing engagement with the wall surface of the bore 64. In the assembled relationship of the rings 130 and 146, the gap 148 is preferably rotatively positioned opposite the tapered end portions of the convolutions 131 and 133.

Referring to FIG. 7, the seal assembly 98 is shown, by way of example, disposed in the groove 92. The scale of drawing FIG. 7 is exaggerated somewhat to show the small clearances that will be developed as a result of pressure fluid acting against the seal assembly in, for example, the operating condition wherein the mandrel 42 is being pulled out of the body 22 and a pressure differential has developed across the restricted bore 64 between the control edges 70 and 71. The pressure of the fluid trapped in the chamber 62 thus acts against the face 134 forcing the seal ring 130 against sidewall 93 of groove 92. The small clearance developed between the surface 134 and the groove opposite sidewall 95 will allow fluid to flow into the groove and also act in a radial outward direction against the inner diameter 150 of the seal ring 146.

Accordingly, pressure fluid entering the groove 92 from either end of the restriction formed by the bore 64 will aid in forcing the seal ring members 130 and 146 into engagement with each other and radially outward into sealing engagement with the wall surface of bore 64, as illustrated in FIG. 7. However, the seal assembly 98 is required to perform a sealing function in only one direction and the seal assembly 96 is operable, in its groove 86, to perform a sealing function in the opposite direction. The provision of the composite seal assembly formed by the seal rings 130 and 146 eliminates the leakage path formed by the axial gap in conventional piston rings and also provides for radial expansion and contraction of the seal assembly for insertion and removal of the seal assemblies with respect to the grooves 90 and 92 and to provide for positive engagement of the seal assemblies with the wall of the restricted bore 64. Moreover, the contiguous flat sides of the convolutions of the spiral seal ring 130 and the tapered free end minimizes the fluid leakage flow path area which, in fact, is nil with the configuration of the member illustrated and described. The tapered ends 140 and 142 may be eliminated in the arrangement illustrated using the piston ring seal 146 as long as the piston ring is of a width at least as great as the spiral ring whereby fluid cannot flow radially inward or outward due to the seal barrier formed by the piston ring seal itself.

The seal ring 130 may be formed of a suitable material such as beryllium copper or phosphor bronze of spring temper grade. The piston ring type seal member 146 may be formed of a suitable piston ring material such as steel or cast iron. The arrangement of the seal assemblies 96 and 98 is also advantageous in that as they move into and out of engagement with the wall of the restricted bore 64, radial compression of the seal ring 130, which is required as the seal assembly engages the control edges 70 or 71, is obtained without a tendency to break the seal rings 130 or 146, or the control edges 70 and 71. The control edges 70 and 71 are defined by respective bevel surfaces intersecting the bore 64 as illustrated.

Those skilled in the art will appreciate that the jar apparatus 12 is provided with a number of improved features which coact to improve the performance of hydraulic drilling jars and the like and, particularly, those types adapted for use in delivering impact blows in opposite directions. Various modifications and substitutions may be made to the specific arrangement disclosed herein without departing from the scope and spirit of the invention as recited in the appended claims.

What I claim is:

1. A hydraulic drilling jar adapted to be inserted in a drill stem for delivering impact blows to said drill stem in response to a longitudinally directed force applied to said drill stem and said jar, said jar comprising:

an elongated hollow cylindrical body including a lower sub for connecting said body to a drill stem member below said jar;

an elongated mandrel member slidably disposed in said body and including an upper end adapted for connecting said mandrel to said drill stem;

said mandrel having a cylindrical portion slidable through a restricted bore portion of said body, said restricted bore portion dividing a space formed between inner bore walls of said body and said mandrel into separate axially spaced apart fluid chambers;

cooperating anvil surfaces on said mandrel and said body for delivering an impact blow to said body;

means forming a substantially fluid tight seal between said chambers when said cylindrical portion passes through said restricted bore portion of said body; and separate passage means interconnecting said chambers and providing controlled flow of fluid from one of said chambers to the other in response to longitudinal movement of said mandrel with respect to said body to provide for axial loading of said drill stem whereby said mandrel is operable to deliver an impact blow to said body when said seal means clears a control edge to permit relatively unrestricted flow of fluid from said one chamber to said other chamber.

2. The drilling jar set forth in claim 1 wherein:

said seal means includes a seal ring disposed on said cylindrical portion of said mandrel and sealingly engageable with a bore wall forming said restricted bore portion of said body, and said restricted bore portion is delimited by a control edge cooperable with said seal means to define the limits of movement of said mandrel with respect to said body during which fluid flow between said chambers is restricted.

3. The drilling jar set forth in claim 1 or 2 wherein:

said passage means is formed in said mandrel.

4. The drilling jar set forth in claim 3 wherein:

said passage means includes a removable plug having a control orifice formed therein and comprising a portion of said passage means.

5. The drilling jar set forth in claim 2 wherein:

said seal means comprises a spiral ring member disposed in a circumferential groove formed in said cylindrical portion of said mandrel.

6. The drilling jar set forth in claim 5 wherein:

said seal means includes a cylindrical piston ring adapted to be disposed in sleeved relationship with said spiral seal ring, said piston ring having an axially extending gap therein to permit radial expansion of said piston ring against the inner bore of said spiral ring.

7. The drilling jar set forth in claim 2 comprising:

further passage means formed in one of said mandrel and said body, check valve means interposed in said further passage means and operable to permit relatively unrestricted flow of fluid between said chambers when said seal ring passes through said restricted bore portion in one direction of movement of said mandrel but preventing flow of fluid through said further passage means in the other direction of movement of said mandrel with respect to said body.

8. The drilling jar set forth in claim 7 wherein:

said mandrel includes at least two spaced apart circumferential grooves formed therein and adapted to receive respective seal rings.

9. The drilling jar set forth in claim 8 wherein:

said further passage means comprises separate passages formed in one of said body and said mandrel, and opposed check valve means interposed in respective ones of said passages to permit fluid flow between said chambers and bypassing one of said seal rings when said mandrel is moved relative to said body in one direction to permit relatively unrestricted movement of said mandrel with respect to said body.

10. The drilling jar set forth in claim 1 wherein:

said mandrel includes an elongated central passage for conducting drilling fluid through said jar, said jar includes a fluid reservoir chamber for storing a quantity of hydraulic fluid supplied to said spaced apart chambers, and piston means delimiting said reservoir chamber and forming a chamber in communication with said central passageway in said jar whereby hydraulic fluid in said chambers is pressurized to at least the pressure of said drilling fluid.

11. The drilling jar set forth in claim 10 wherein:

said body includes an upper sub, a first body member, a second body member and a lower sub threadedly engaged in serial end to end relationship and defining said chambers.

12. The drilling jar set forth in claim 11 further comprising:

annular sleeve bearing means disposed in said upper sub, said second body member and said lower sub for supporting said mandrel for sliding relationship with respect to said body.

13. The drilling jar set forth in claim 1 wherein:

said body includes an upper sub having an upwardly facing anvil surface operable to receive impact blows from a first cooperating anvil surface formed on an annular member removably connected to said mandrel.

14. The drilling jar set forth in claim 13 wherein:

said upper sub includes a downwardly facing anvil surface operable to receive impact blows from a second anvil surface on said mandrel.

15. The drilling jar set forth in claim 1 wherein:

said mandrel comprises a first elongated part including said upper end and an elongated wash pipe removably connected to said first part at the end opposite said upper end, and said mandrel includes an elongated mandrel sleeve member slidably disposed on and nonrotatably secured to said first part, cooperating splines formed on said sleeve and said body operable to permit relative axial sliding movement of said mandrel with respect to said body but preventing rotation of said mandrel with respect to said body.

16. The drilling jar set forth in claim 15 wherein:

said sleeve is retained on said first part by said wash pipe.

17. The drilling jar set forth in claim 15 wherein:

said sleeve includes an upwardly facing anvil surface operable to deliver impact blows to a downwardly facing anvil surface on said body.

18. The drilling jar set forth in claim 15 wherein:

said first part of said mandrel includes a first seal diameter extending through seal means disposed on said body and engageable with said seal diameter and delimiting one end of one of said fluid chambers, said wash pipe includes said cylindrical portion which is of a diameter larger than said first seal diameter whereby upon movement of said wash pipe toward said seal means on said body the volume of said one chamber is decreased.

19. The drilling jar set forth in claim 18 wherein:

said sleeve is disposed in said one chamber.

20. A bidirectional hydraulic drilling jar adapted to be inserted in a drill stem or the like for delivering impact blows in an upward or downward direction to said drill stem, said drilling jar comprising an elongated hollow cylindrical body, an elongated mandrel slidably disposed in said body and including an upper end adapted to be connected to said drill stem;

cooperating anvil surfaces on said mandrel and said body for delivering impact blows between said mandrel and said body in both upward and downward directions of said drill stem;

said mandrel including a portion cooperable with a restricted bore portion of said body to restrict the flow of hydraulic fluid between two chambers formed by said mandrel and said body whereby axial loading may be imposed on said mandrel in moving said mandrel with respect to said body in one direction or the other, means defining two spaced apart control edges on one of said body and said mandrel cooperable with spaced apart seal means on the other of said body and said mandrel in such a way that upon movement of one of said seal means past one of said control edges, said mandrel may undergo sudden relatively unrestricted movement to deliver an impact blow to said body;

means forming a restricted flow path of hydraulic fluid between said chambers;

separate passage means bypassing each of said seal means, respectively, opposed check valves disposed in each of said passage means and operable to permit flow of fluid between said chambers through said passage means to provide unrestricted movement of said mandrel in one direction but not the other when said mandrel portion and said seal means associated with said one check valve are effectively sealing one chamber from the other so that said mandrel may be moved freely in one direction over a predetermined distance with respect to said body but is retarded by the restricted flow of fluid through said restricted flow path in the other direction of movement of said mandrel with respect to said body whereby said mandrel may be moved in either direction for axial loading of said mandrel and said drill stem.

21. The drilling jar set forth in claim 20 wherein:

said control edges are formed on said body and delimit said restricted bore portion.

22. The drilling jar set forth in claim 20 or 21 wherein:

said seal means comprise spaced apart seal rings disposed on said mandrel and slidably engageable with said restricted bore portion, said cylindrical portion of said mandrel includes a recess formed therein between said seal rings, and said restricted flow path means comprises separate passage means in said mandrel in communication with said recess and adapted to form a fluid flow path around said seal rings, respectively, when said seal rings are disposed in said restricted bore portion.

23. The drilling jar set forth in claim 22 wherein:

said restricted flow paths are provided by separate orifice means interposed in said separate passage means in said mandrel, respectively.

24. The drilling jar set forth in claim 23 wherein:

said orifices are formed in plug members removably disposed in said separate passage means in said mandrel.

25. A hyraulic drilling jar adapted to be inserted in a drill stem for delivering impact blows to said drill stem in response to a longitudinal force applied to said drill stem and said drilling jar, said drilling jar including an elongated hollow body, a mandrel comprising an elongated tubular member slidably disposed in said body, said mandrel and said body defining spaced apart fluid chambers separated by a retricted bore portion of said body and a cooperating cylindrical portion of said mandrel, said body including an upper end sub including seal means cooperable with a seal diameter on said mandrel to delimit the upper end of one of said chambers, and second seal means spaced from said first seal means and cooperable with a second seal diameter on said mandrel and delimiting the lower end of the other of said chambers, and means on said mandrel disposed in said one chamber and cooperable with means on said body to preclude rotation of said mandrel with respect to said body.

26. The drilling jar set forth in claim 25 wherein:

said mandrel includes an elongated sleeve mounted on said mandrel and including spline means formed thereon and engageable with cooperating spline means formed on said body to permit relative axial but not rotatable movement of said mandrel with respect to said body.

27. The drilling jar set forth in claim 26 wherein:

said sleeve includes an anvil surface formed on one end of said sleeve and cooperable with an anvil surface on a portion of said body for delivering impact blows to said body.

28. The drilling jar set forth in claim 26 wherein:

said sleeve is retained on a first part of said mandrel by shoulder means formed on a second part of said mandrel threadedly connected to one end of said first part.

29. The drilling jar set forth in claim 28 wherein:

said cylindrical portion on said mandrel is formed on said second part and is of a larger diameter than said first seal diameter.

30. A seal assembly for sealing a circumferential annular space between a cylindrical mandrel and a restricted bore in a hollow body of a downhole tool or the like, said mandrel and said body being adapted for linear movement with respect to each other and said mandrel being adapted to receive said seal assembly in a circumferential groove formed in said mandrel, said seal assembly comprising:

a radially expandable spiral seal ring comprising a member having a plurality of convolutions and opposed free ends of said convolutions, said spiral seal ring having an inner circumference; and a cylindrical ring member adapted to fit within and engageable with said inner circumference of said spiral seal ring for yieldably biasing said spiral seal ring radially outwardly into sealing engagement with said restricted bore in said body.

31. The seal assembly set forth in claim 30 wherein:

said spiral seal ring is formed of a continuous member of rectangular cross-section, the convolutions of said spiral seal ring being formed such that adjacent sides of adjacent convolutions are contiguous with each other and at least one end face of said spiral seal ring is formed to be a flat surface which is perpendicular to the central axis of said spiral seal ring.

32. The seal assembly set forth in claim 31 wherein:

said free ends of said convolutions are tapered to a sharp edge to minimize a radial leakage path between said free ends and a side surface of the convolution adjacent to said free ends.

33. The seal assembly set forth in claim 30 wherein:

said cylindrical ring member includes an axially extending gap to permit radial expansion of said cylindrical ring member, and said cylindrical ring member is inserted within said spiral ring member with said gap positioned nonaligned with said free ends of said spiral ring member.

* * * * *